United States Patent [19]

Landquist

[11] Patent Number: 4,948,342

[45] Date of Patent: Aug. 14, 1990

[54] METHOD AND DEVICE FOR AUTOMATIC CIRCULATION IN A WASTE WATER PUMP STATION

[75] Inventor: Folke Landquist, Balsta, Sweden

[73] Assignee: Flygt AB, Solna, Sweden

[21] Appl. No.: 443,611

[22] Filed: Nov. 29, 1989

[30] Foreign Application Priority Data

Feb. 21, 1989 [SE] Sweden ..... 8900597

[51] Int. Cl.[5] ..... F04B 49/02

[52] U.S. Cl. ..... 417/279; 417/430; 415/146; 137/514

[58] Field of Search ..... 417/279, 299, 430; 415/146, 49; 137/514

[56] References Cited

U.S. PATENT DOCUMENTS

| | | | |
|---|---|---|---|
| 3,316,843 | 5/1967 | Vaughan | 417/430 |
| 3,714,964 | 2/1973 | Livingston | 137/514 |
| 4,462,766 | 7/1984 | Carlsson et al. | 417/430 |

*Primary Examiner*—Leonard E. Smith
*Assistant Examiner*—Robert N. Balackmon
*Attorney, Agent, or Firm*—Menotti J. Lombardi

[57] ABSTRACT

The pressure side of the pump unit is provided with a valve (6) which during certain periods opens a connection between the pump and the pump station to obtain circulation in the station. The valve (6) is opened and closed by a valve ball (9) which is controlled by the pump pressure.

13 Claims, 4 Drawing Sheets

METHOD AND DEVICE FOR AUTOMATIC CIRCULATION IN A WASTE WATER PUMP STATION

BACKGROUND OF THE INVENTION

The invention relates to a device for providing circulation in pump stations which are parts of a municipal sewage system.

As disclosed in U.S. Pat. No. 4,462,766, issued July 31, 1984, sludge banks occur in pump stations and other tanks in a sewage system due to poor circulation. Sludge banks can cause a number of problems including bad odors, risk of explosions, corrosion problems, etc.

According to the foregoing Patent, the problems have been solved by arranging a valve in the pump outlet, which is opened temporarily thus obtaining a circulation and flushing in the pump station. The sludge banks are dissolved and the fluid is homogenized.

The adjustment of the valve has been electrically controlled by means of a linear motor which acts upon a slide in the valve. A disadvantage with this solution, in addition to a relatively high cost, is that it easily becomes clogged as the pumped medium normally contains large amounts of solid bodies such as stones, rags and other objects. If a stone is stuck in the valve slide, the electric motor may break down.

Another disadvantage is that the motor of the valve is electrically driven which means specific installation problems where explosive gas may occur.

SUMMARY OF THE INVENTION

An object of this invention is to provide a method and a device which in a simple and reliable way controls the valve and which is less sensitive to clogging.

According to the broader aspects of the invention, the valve located on the pressure of the pump is opened and closed by a valve ball which is controlled by the pump pressure.

BRIEF DESCRIPTION OF THE DRAWINGS

Other objects, features and advantages of the present invention will become more fully apparent from the following detailed description of the preferred embodiment, the appended claims and the accompanying drawing in which:

DETAILED DESCRIPTION OF THE PREFERRED EMBODIMENT

Figure 1:
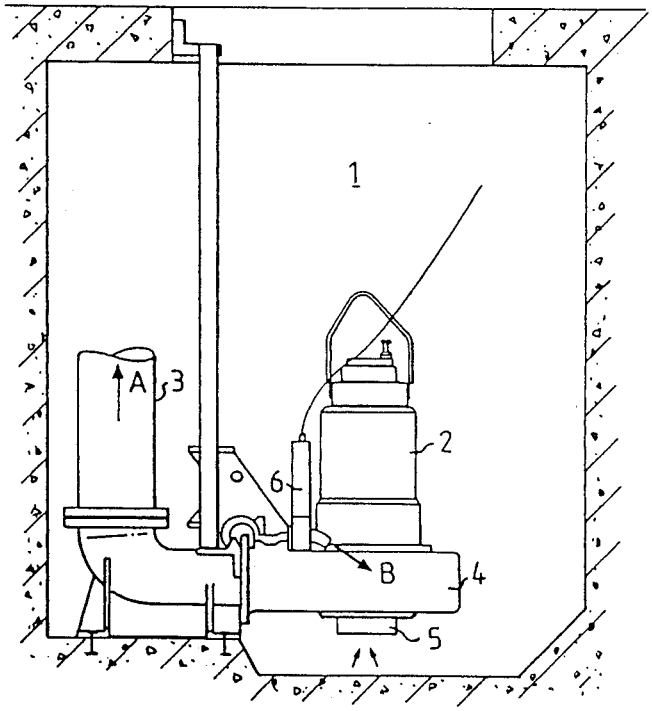
FIG. 1 shows a pump station with a pump unit and attached valve.

Referring now to the drawings, a pump station 1 with a submersible pump unit 2 is connected to a pressure pipe 3. The pump housing 4 has an inlet 5, and a mixing valve 6 is mounted on the pump housing 4. A cylinder 7 is formed as part of the valve 6 with its outlet 8. A valve ball 9 is displaceable to its seat 10. A diaphragm 11 is located in a cup 12 with an opening 13 and an attached bellows 14.

In operation, the valve 6 is normally closed and the pumped medium is transported from the pump housing 4 into the pressure pipe 3. The flow direction is shown by the Arrow A in FIG. 1. During certain times, for instance at pump start, the valve 6 is open, which means that a certain amount of the pumped medium flows through the valve in the direction of arrow B, and provides a strong agitation in the pump station to dislodge possible sludge banks. After a certain time, the valve 6 is closed and the pumping takes place in the normal way.

The valve 6 includes the cylinder formed part 7 and the outlet nozzle 8. A bellows 14 is connected to the cylinder part 7, which bellows encloses a valve cup 12 containing a diaphragm 11 with a valve ball 9. The ball 9 is arranged to be able to close the cylinder part 7 when it is pressed against the seat 10 in part 7.

Figure 2:
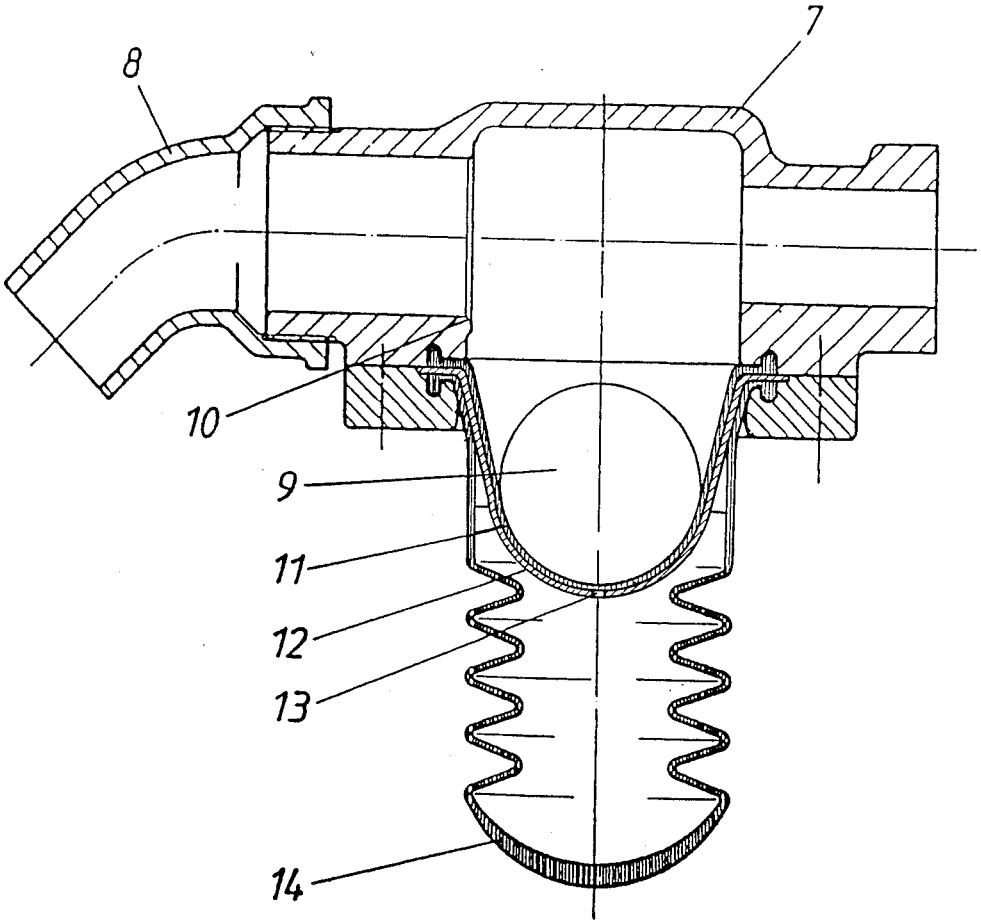
FIGS. 2 to 4 show the principle design of the valve in different operating positions.

In FIG. 2, the valve 6 is shown in open position which means that circulation takes place within the pump station. The valve ball 9 in this position is out of the flow path, not hindering it. The flow through the part 7 then quickly creates an under pressure which effects diaphragm 11 and causes a closing of the valve after a certain time.

Since the diaphragm 11 is sealingly attached to the cylinder part 7, the under pressure created in part 7 will urge the diaphragm 11 with ball 9 to move upwards into the part 7 in direction of arrow 9A. The movement of the diaphragm 11 into part 7 is prevented by the fact that the valve cup 12 and the bellows 14 are also sealingly attached in the part 7.

The valve cup 12 has an opening 13, which allows passage of a damping medium, normally oil, contained within the bellows 14 moving in direction of arrow 14*a*, into the space between the cup 12 and the diaphragm 11 as shown by arrows 13*a,b*. The diaphragm 11 can then be sucked into the part 7. The speed of this movement is decided by the area of the opening 13 and the magnitude of the underpressure in the part 7.

Figure 3:
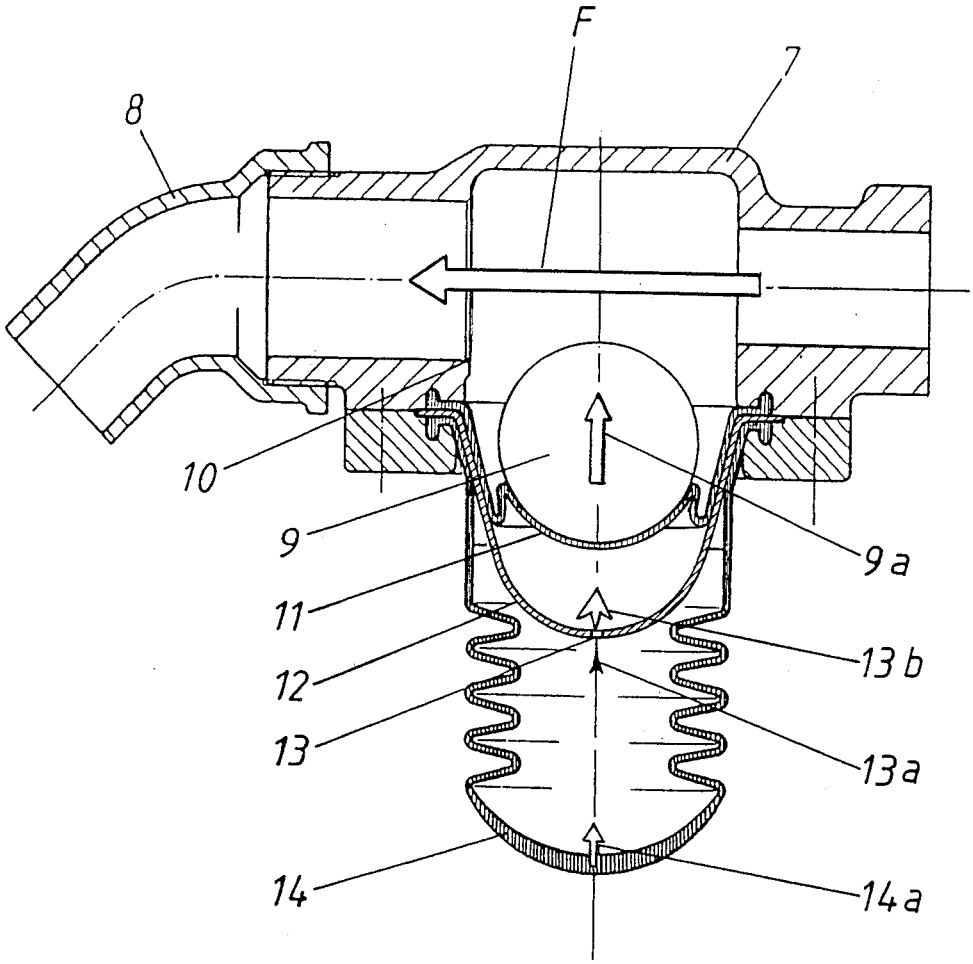
Figure 4:
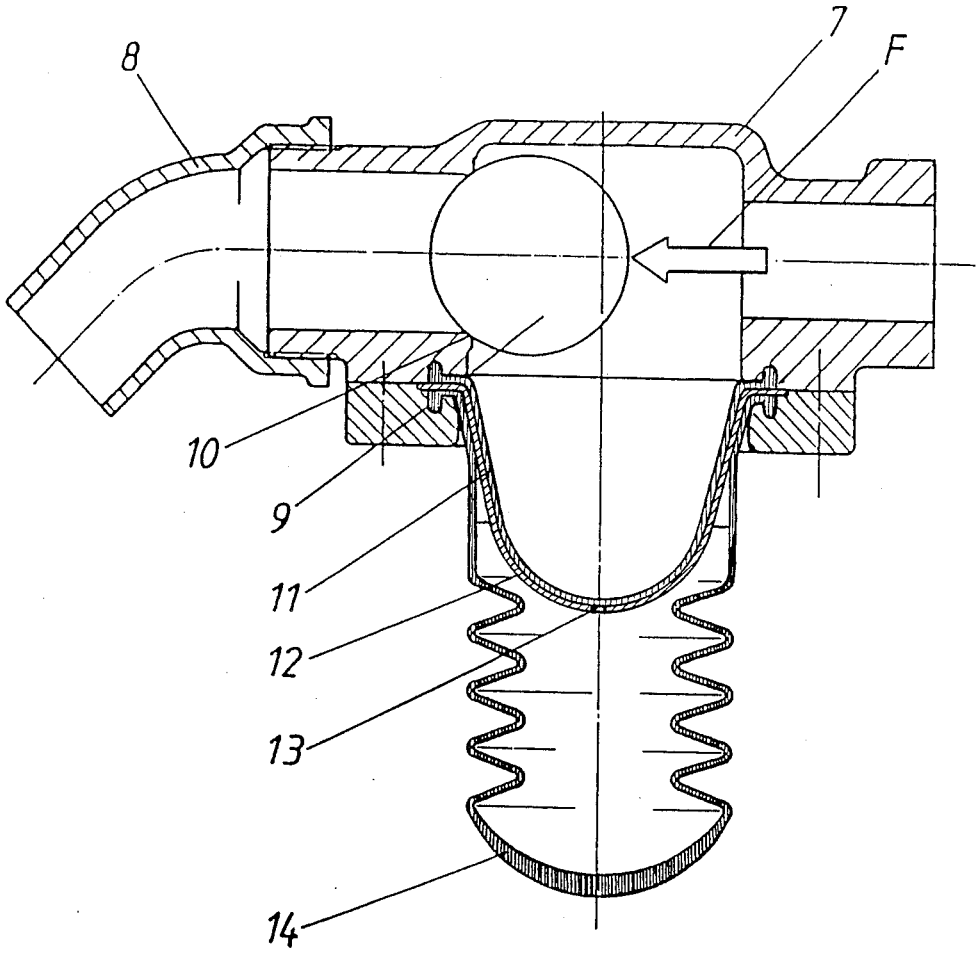

FIG. 3 shows the position where the diaphragm 11 and the ball are in progress moving into the flow F in the part 7. After a little while the ball 9 has been moved so far into the flow in the part 7, that the flowing medium presses the ball against the seat 10 as shown in FIG. 4 thus closing the valve. This is then kept closed as long as pumping continues.

During this time the pump pressure prevails in the part 7 which means that the diaphragm 11 is pressed back towards its initial position at a speed which is decided by the flow rate of the damping medium through the opening 13, back into the bellows 14. FIG. 4 shows the valve in a closed position when the diaphragm has reached its initial position. When the pumping is stopped, the pressure goes down and the ball 9 resumes the position shown in FIG. 2, thus opening the valve before the next pump start cycle.

In the above description, the valve ball is heavier than the pumped medium such that the bellows, cup and diaphragm arrangement are below the valve. The invention, however, contemplates an embodiment wherein the ball has a density lower than that of the pumped medium, and therefore the bellows device would be arranged above the valve so that the ball comes to the surface for opening of the valve before next pump start cycle.

According to another embodiment of the invention, an outer conduit may be connected to the cylinder part 7, where additives such as gas, chemicals, etc. can be sucked into the flow when the valve is open. This outer conduit may also be used for letting in air to delay or control the closing time at a simultaneous aeration of the pumped medium.

In the foregoing description, the closing element is a valve ball 9, however, other movable or turnable means may be used as closing elements. The invention provides a very simple and reliable device for controlling of the mixing valve for primarily waste water pumping. The valve does not need any additional energy source and can be easily set for different opening periods.

While the present invention has been disclosed in connection with a preferred embodiment thereof, it should be understood that there may be other embodiments which fall within the spirit and scope of the invention as defined by the following claims.

I claim:

1. A method to control a valve for obtaining circulation in sewage pump water stations containing one or several pump units, preferably centrifugal pumps of the submersible type, one or several provided with mixing valves, which automatically, during a certain limited time period (periods) connect the pressure side of a pump with the pump station thus obtaining a circulation of the pumped medium and where the alternate return connection to the pump station is carried out by help of a valve comprising a cylinder formed part connected to the pressure side of the pump and an outlet nozzle, characterized in that the control is obtained by help of a movable element (9) which, in dependence of the pressure situation in the valve, in its one rest position seals against a seat (10) in the valve thus closing the latter and which in its other rest position is contained within a diaphragm (11) arranged in a bellows (14) sealingly attached to the valve (6).

2. A method according to claim 1, characterized in that the valve element (9) in its closed position is pressed against its seat (10) by the pump pressure.

3. A method according to claim 1, characterized in that the valve element (9) is forced from its open to its closed position by under pressure which is created in the valve (6) by the flow.

4. A method according to claim 3, characterized in that the valve element (9) is moved from open to closed position at a speed which is determined by the area of an opening (13) between two rooms within the bellows (14) between which rooms a medium is exchanged when the valve element (9) is moved.

5. A device for obtaining circulation in a sewage pump water station containing one or several pump units, preferably centrifugal pumps of the submersible type, which device comprises mixer valves connected to one or several of the pump units, which valves automatically during a certain limited period (periods) connect the pressure side of a pump with the pump station thus obtaining a circulation of the pumped medium and where the alternate return connection to the pump station is carried out by a valve comprising a cylinder formed part connected to the pressure side of the pump and an outlet nozzle, characterized in that to the cylinder formed part (7) of the valve (6) there is sealingly attached a bellows (14) which contains a sealingly connected diaphragm (11) and a valve element (9) which, in dependence of the pressure situation in the valve, in its one rest position seals against a seat (10) in the valve (6) thus closing the latter and which in its other rest position is contained in the valve cup (12) without hinderance to the flow through the valve (6).

6. A device according to claim 1, characterized in that the valve cup (12), which parts the inner of the bellows (14) from a space between the valve cup (12) and the diaphragm (11) heading the valve (6), is provided with an opening (13) which allows a medium to be exchanged between the two rooms.

7. A device according to claim 5, characterized in that bellows (14) is filled with a damping medium such as oil.

8. A device according to claim 5, characterized in that the valve element (9) is a ball.

9. A device according to claim 5, characterized in that the valve (6) is provided with a connection for air intake for delaying or controlling the closing time.

10. In combination:

a cylinder part with a flow channel connected to the pressure side of a pump and having an outlet nozzle and a seat in said flow channel;

a bellows sealingly attached to said part and containing a sealingly connected diaphragm and valve cup; and a valve element located within said diaphragm and movable from a first position to a second position against said seat depending on the flow in said channel.

11. The combination of claim 10 wherein said valve cup includes an opening to permit a fluid medium to be exchanged between an area located between said bellows and said cup and an area between said diaphragm and said cup.

12. The combination of claim 11 wherein said fluid medium is a damping medium such as oil.

13. The combination of claim 12 wherein said valve element is a ball.

* * * * *